United States Patent [19]

Cleusix et al.

[11] Patent Number: 4,509,867

[45] Date of Patent: Apr. 9, 1985

[54] ELECTRONIC TIMEPIECE MOVEMENT

[75] Inventors: Willy Cleusix, Le Landeron; François Nikles, Cornaux, both of Switzerland

[73] Assignee: Ebauches Electroniques S.A., Switzerland

[21] Appl. No.: 564,747

[22] Filed: Dec. 22, 1983

Related U.S. Application Data

[63] Continuation of Ser. No. 253,576, Apr. 13, 1981, abandoned.

[30] Foreign Application Priority Data

Apr. 30, 1980 [CH] Switzerland ..... 3329/80

[51] Int. Cl.[3] ..... G04B 29/00

[52] U.S. Cl. ..... 368/321; 368/320; 368/190; 368/187

[58] Field of Search ..... 368/69, 70, 74, 82–84, 368/187, 188–190, 319–321; 200/159 R

[56] References Cited

U.S. PATENT DOCUMENTS

| | | | |
|---|---|---|---|
| 2,808,538 | 7/1957 | Kuhn | 200/159 R X |
| 3,841,081 | 10/1974 | Komaki | 368/189 |
| 3,874,162 | 4/1975 | Boxberger | 368/190 X |
| 3,922,844 | 12/1975 | Sakamoto | 368/76 X |
| 3,952,176 | 4/1976 | Holder et al. | 200/11 R |
| 3,974,351 | 8/1976 | Solor et al. | 200/159 R |
| 3,975,897 | 8/1976 | Naito | 368/224 |
| 4,034,551 | 7/1977 | Ushiyama | 200/159 R |
| 4,043,115 | 8/1977 | Bryceland | 368/69 |
| 4,074,093 | 2/1978 | Ikehata et al. | 368/187 X |
| 4,199,932 | 4/1980 | Berney | 368/188 |
| 4,263,666 | 4/1981 | Murata | 368/187 |
| 4,319,351 | 3/1982 | Fujimori | 368/187 |

*Primary Examiner*—Bernard Roskoski

*Attorney, Agent, or Firm*—Silverman, Cass & Singer, Ltd.

[57] ABSTRACT

An electronic timepiece movement includes a control stem slidably guided in a radial passage of a base plate. Pulling on this control stem brings a return spring acting on the stem into contact with a stud which is carried by the substrate of an electronic circuit module of the movement. This connects a conductive lead to ground, which controls an operation function of the timepiece. The pull-out control stem and associated return spring can be replaced by a push-in member and by a return coil spring located in said passage. The stud is then positioned in a hole of the substrate of the electronic circuit, which hole is situated opposite to the longitudinal axis of the passage. Pressure exerted on this push-in member places a portion thereof into electrical contact with the stud and this connects the lead to ground, as before. Thus, the movement can according to choice be completed for operation either by a push-in control movement or by a pull-out control stem movement.

6 Claims, 4 Drawing Figures

ELECTRONIC TIMEPIECE MOVEMENT

This application is a continuation, of application Ser. No. 253,576, filed Apr. 13, 1981 now abandoned.

BACKGROUND OF THE INVENTION

1. Field of the Invention

The present invention relates to an electronic timepiece movement.

2. Description of the Prior Art

In electronic timepieces, especially in wristwatches, the several functions of the watch are controlled, most generally, by means of a push-button which the user depresses a certain number of times.

Mechanical watches, on the contrary, more generally comprise a control stem which can occupy a plurality of axial positions, and which is rotatably operated.

It has turned out that some users of electronic watches do not like the normal way of controlling them by means of push-buttons and instead require conventional control stems. In order to satisfy such users, electronic watches have been made with a function control member which is constituted by an axially movable stem, provided with a gripping head on which the user exerts a number of outward pulls. The effect of this is the same as that of the depressions of the push-buttons of a conventional electronic timepiece.

This alternative requirement gives rise to manufacturing problems. As a matter of fact, if the watchmakers, who sell the watches, were themselves to manufacture the movements which they use, it would be relatively easy for them to adopt one or the other of the above mentioned arrangements and to produce movements adapted to their own requirements. However, manufacturers who produce their own movements are the exception, the majority buying the movements they need from specialist manufacturers thereof. Consequently, it is at the level of the manufacturer of movements that difficulty has arisen as they have to supply, in order to satisfy their customers, movements of both types.

SUMMARY OF THE INVENTION

The object of the present invention is to achieve considerable simplification in the manufacture of the movements of electronic timepieces while furnishing the manufacturers of the movements with means which enable them, with resultant reduction of the number of components and assembly operations, to complete the movements either in the form of movements having control mechanisms with push-buttons or in the form of movements having control mechanisms with pull-out stems.

The various features of the invention will be apparent from the following description, drawings and claims, the scope of the invention not being limited to the drawings themselves as the drawings are only for the purpose of illustrating a way in which the principles of the invention can be applied. Other embodiments of the invention utilising the same or equivalent principles may be used and structural changes may be made as desired by those skilled in the art without departing from the present invention and the purview of the appended claims.

Figure 1:
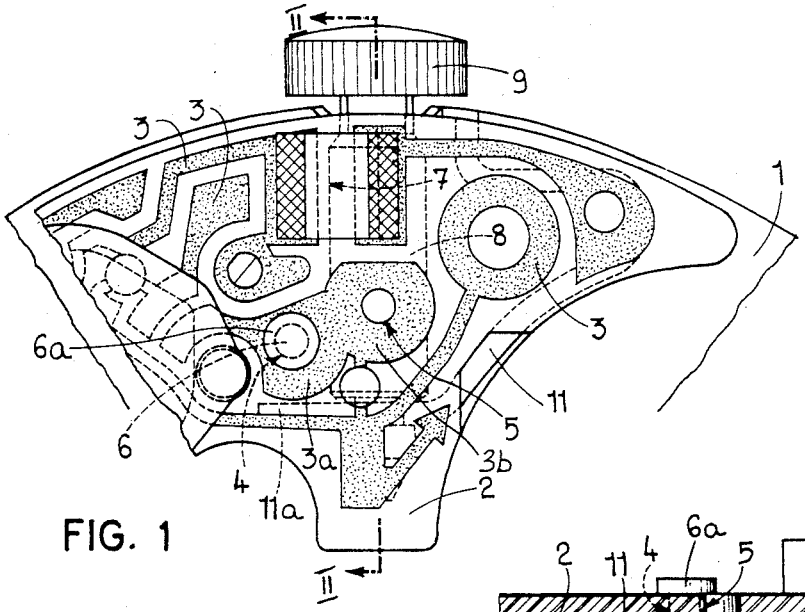
FIG. 1 is a partial plan view of an electronic watch movement illustrating a control member constituted by a stem which is pulled out to control the functions of the watch.
Figure 2:
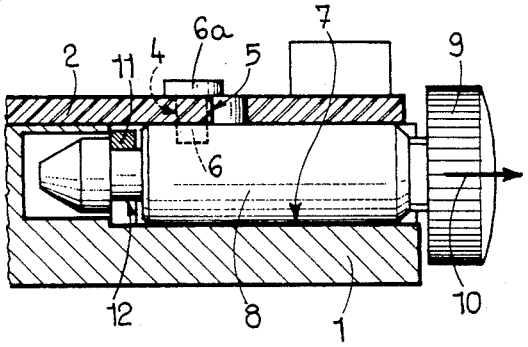
FIG. 2 is a sectional view of the watch movement taken along the line II—II of FIG. 1.

The frame of the watch movement illustrated in FIGS. 1 and 2 comprises a metal base plate 1 carrying several component elements of the movement. These comprise, among others, a substrate plate 2 on which is deposited a printed electronic circuit having conductive leads 3, and, in particular, having a pair of leads 3*a* and 3*b* located in two independent positions on the substrate and each for specifically initiating the same timepiece control or time setting functions.

The substrate 2 is provided at said lead 3*a* with an opening 4 and at said lead 3*b* with an opening 5 the purpose of which openings will be referred to later. The opening 4 is occupied by a metal stud 6 provided with a head 6*a* in electrical contact with the lead 3*a*.

The base plate 1 is provided with a radial passage 7, formed by substrate plate 2 being spaced from base plate 1, in which is slidably engaged a stem 8 carrying, at its outer end, a crown 9 providing an external control knob by which the stem can be manually pulled out in the direction illustrated by the arrow 10 of FIG. 2. Radial passage 7 opens to exterior of the movement and the timepiece in which the movement is installed. A leaf spring 11 carried by the base plate 1 engages in a groove 12 adjacent one end of the stem 8 and serves to return the stem radially in the opposite direction towards the center of the movement, in the same manner as the springs of the pull-out winders of conventional mechanical timepieces.

The arrangement is such that, when the stem 8 is manually pulled axially through the intermediary of the crown 9, the end of the spring 11, designated 11*a*, contacts the end of the stud 6, and thus connects the latter to electrical ground. The stud 6 being in electrical contact with the lead 3*a* of the electronic circuit, this lead is then connected to ground, which effects control of a function of the watch. The user will operate on the crown 9 to pull out the stem 8 for the number of times determined by the function he wishes to obtain.

Figure 3:
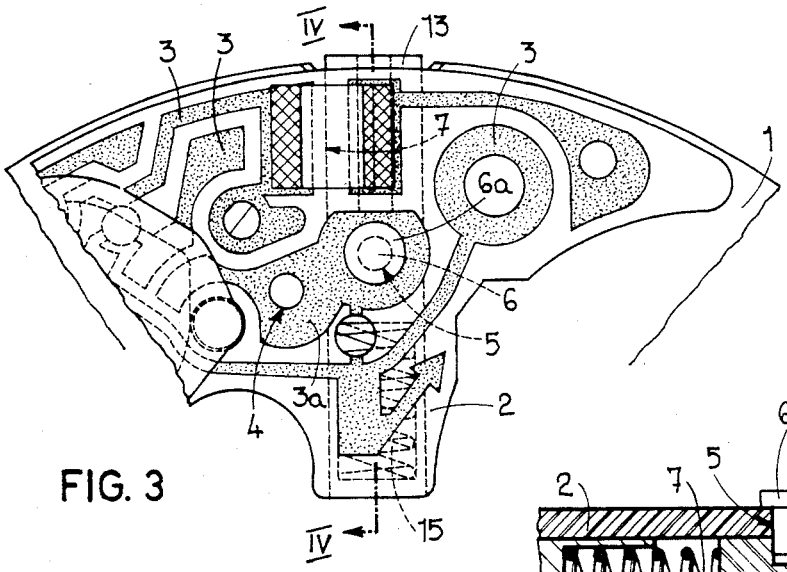
FIG. 3 is a partial plan view of an electronic watch movement illustrating a control member constituted by a push-in member which is depressed to control the functions of the watch.
Figure 4:
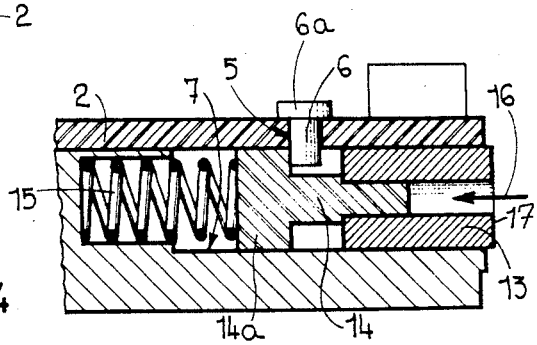
FIG. 4 is a sectional view of the watch movement taken along the line IV—IV of FIG. 3.

In the movement illustrated in FIGS. 3 and 4, the stem 8, the crown 9 and the spring 11 have been eliminated and replaced by a push-in member composed of two elements, namely a metallic sleeve 13 and an insulating stud 14 with a stem the end of which is engaged in the inner end of the sleeve, and by a coil spring 15. These are all located in the passage 7, the spring 15 acting on a head 14*a* of the stud 14 to apply a return force urging the stud and the sleeve radially in the outward direction. The stud 6 is located in the hole 5 of the substrate 2, this hole being situated radial of the axis of the passage 7. As previously mentioned, the stud 6 is in contact with the conductive lead 3*b* of the electronic circuit.

When the mechanism is at rest, the stud 6 serves as an abutment member for the push-in member, the head 14*a* of the insulating stud bearing thereon. When a pressure is exerted manually or by means of a pointed instrument on an actuating button end 17 the sleeve 13, to depress it axially inwardly in the direction of the arrow 16 of FIG. 4, the end of this sleeve contacts the stud 6, connecting the latter and consequently also the lead 3*b* of the electronic circuit, to ground.

Thus, a pressure exerted on the push-in member 13–14 has exactly the same effect as a pull exerted on the stem 8 of FIGS. 1 and 2.

It can thus be seen that a manufacturer of watch movements can satisfy his customers' alternative requirements by means of an appropriate set of component elements, which are small in number. They comprise the stem 8 and spring 11 in the case of the movements having a pull-out stem control, and the sleeve 13, stud 14 and spring 15 in the case of movements having a push-in member control. The final assembly operation or, if necessary, the conversion of movements from one type to the other are effected with a minimum of assembly operations, since it is merely necessary to fit one or the other of the two sets of components mentioned above and accordingly to place the stud 6 in the corresponding one of the holes 4 and 5 of the substrate 2.

The control mechanism includes the two sets of components mentioned and the multi-directional movability of the components selects the one of said leads 3*a* and 3*b* that are electrically connected to the contact member, stud 6.

We claim:

1. In an electronic timepiece movement having a base plate, a substrate plate supported on said base plate and a printed electrical circuit deposited on said substrate plate which includes a pair of electrically conductive leads each for specifically initiating the same timepiece setting functions by means of a manually actuable control mechanism which establishes electrical contact selectively with individual ones of said leads for performing said functions, the herein invention comprising:

1. said control mechanism including an electrically conductive contact member mounted on the substrate plate in electrical connection selectively with one of said leads of the printed circuit;
2. said base plate and substrate plate being spaced apart to form a radially extending passage opening to exterior of the timepiece;
3. said mechanism including means axially movable in said passage and protruding outwardly from the passage for initiating said movement manually from exterior of the timepiece;
4. said mechanism also including an electrically conductive member selectively actuated by movement of said means into electrical contact with said contact member whereby to initiate said timepiece setting functions through the lead with which said contact is connected;
5. said printed circuit having said leads located in two independent positions on said substrate plate; and
6. said means being movable multi-directionally on its axis for selecting the one of said leads which is electrically connected to the contact member.

2. The timepiece movement of claim 1 in which said means axially movable in said passage include a groove adjacent one end thereof, and said electrically conductive member includes a return leaf spring having an electrically conductive end engaged in said groove and electrically connected to circuit ground, the end of said leaf spring further being engaged with said contact member upon manual axial movement of said means in one of said multi-directions to connect said contact member to electrical ground.

3. The timepiece movement of claim 2, in which said means include a control member having a central stem, said groove at one end and a crown at the other end providing an external control knob for initiating said movement in said one of said multi-directions manually from exterior of the timepiece.

4. The timepiece movement of claim 1 in which said electrically conductive member includes an electrically conductive sleeve that is electrically connected to ground, one end of said sleeve being engaged with said contact member upon manual axial movement of said means in another of said multi-directions to connect said contact member to electrical ground.

5. The timepiece movement of claim 4 in which said means include: a button end of said sleeve opposite said one end engaging said contact member, an insulating stud engaged with said sleeve one end and providing a shoulder spaced from said one end a distance greater than the intervening dimension of said contact member, and a compression spring urging said shoulder against said contact member.

6. The timepiece movement of claim 1 in which there is an opening through the substrate plate at each of said pair of leads and said contact member is a headed stud, the stud being inserted in the opening associated with the selected lead and the head of the stud being electrically connected with the associated lead, with the stud body being electrically contacted by said electrically conductive member.

* * * * *